US006142918A

United States Patent [19]

Liu

[11] Patent Number: 6,142,918

[45] Date of Patent: Nov. 7, 2000

[54] BARBELL SYSTEM

[76] Inventor: Ping Liu, No. 8 Qianyingfang Street, Taiyuan, Shanxi, China

[21] Appl. No.: 09/436,224

[22] Filed: Nov. 9, 1999

[51] Int. Cl.[7] ..... A63B 21/072

[52] U.S. Cl. ..... 482/108; 16/430

[58] Field of Search ..... 482/106–108; D21/680–682; 16/430; D8/303

[56] References Cited

U.S. PATENT DOCUMENTS

| | | | |
|---|---|---|---|
| D. 378,535 | 3/1997 | Wilber | D21/681 |
| D. 409,266 | 5/1999 | Rojas et al. | D21/681 |
| 5,135,455 | 8/1992 | King et al. | 482/108 |
| 5,823,922 | 10/1998 | Eckmann | 482/108 |

OTHER PUBLICATIONS

*Body Solid* 1993 Catalog Fitness Equipment & Free Weights pp 30 Dumbbell Handles w/ Spin Lock Collars.

*Primary Examiner*—John Mulcahy

[57] ABSTRACT

A barbell system includes a grip having an axial length and an axial bore with a diameter and planar end faces and a contoured exterior surface. The contoured exterior surface has a maximum diameter at its radial central plane and at its ends and a minimum diameter at its radial intermediate planes symmetrically positioned between the central plane and the ends. The exterior surface is formed with three circumferentially positioned regions around the periphery to form flat ovals. The central ovals are all located in three planes 120 degrees from each other with a major axis parallel with the axis of the grip and shaft and a minor axis transverse to the axis of the grip and shaft.

7 Claims, 3 Drawing Sheets

FIG 3
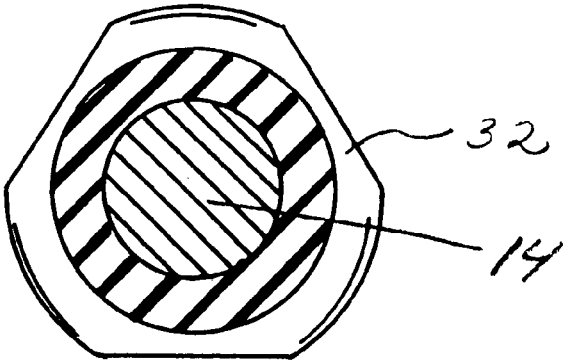
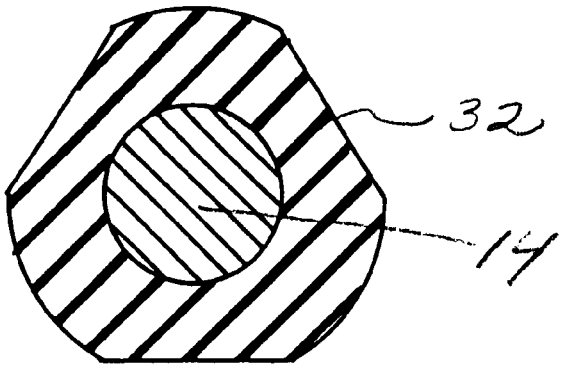
FIG 4

FIG 5
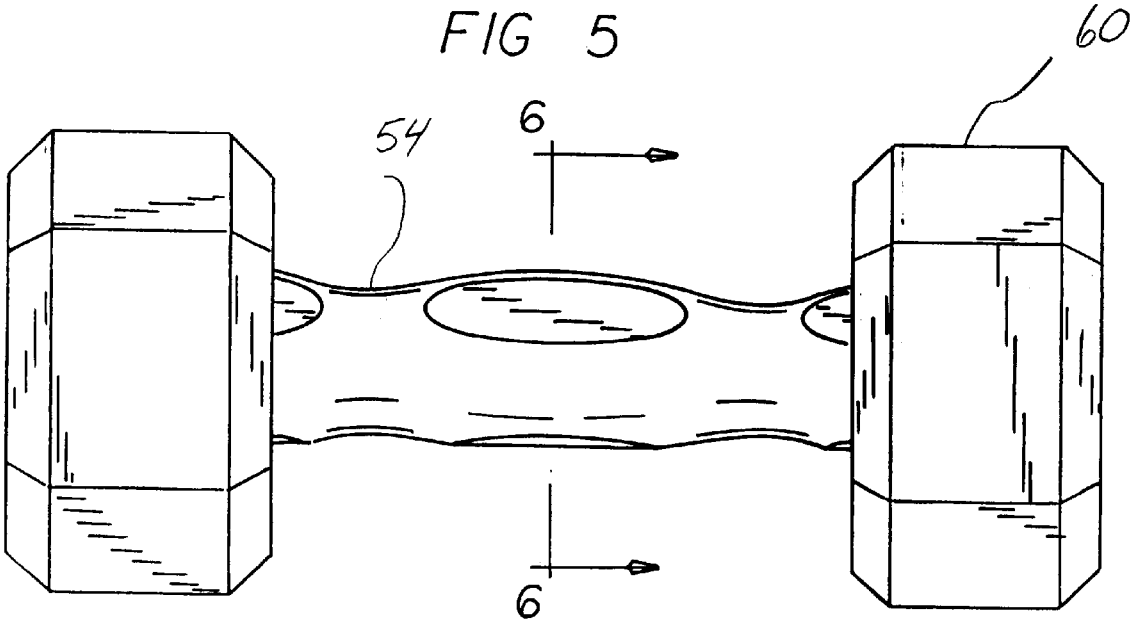
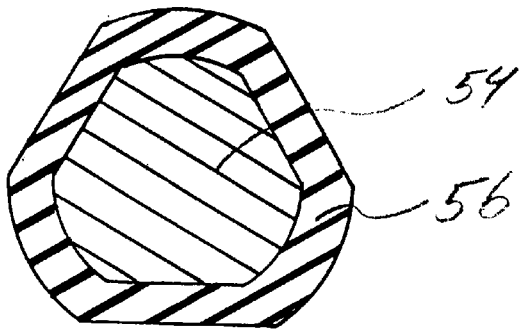
FIG 6

BARBELL SYSTEM

BACKGROUND OF THE INVENTION

1. Field of the Invention

The present invention relates to a barbell system and more particularly pertains to improving the gripability of barbell systems.

2. Description of the Prior Art

The use of barbells and grips of known designs and configurations is known in the prior art. More specifically, barbells and grips of known designs and configurations heretofore devised and utilized for the purpose of rendering grips as for barbells for increased comfort are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,229,658 to E. Sandow discloses a dumb bell. U.S. Pat. No. 5,242,349 to Reiff et al. discloses an arm exercise apparatus. U.S. Pat. No. 5,520,073 to Bakula et al. discloses a reversible ratcheting screwdriver with spinner and ergonomic handle. U.S. Pat. No. Des. 256,546 to Holland-Letz discloses a screwdriver handle. U.S. Pat. No. Des. 297,751 to Brown discloses an aerobic handweight. U.S. Pat. No. Des. 401,491 to Shiao discloses a tool handle. Lastly, U.S. Pat. No. Des. 408,252 to Holland-Letz discloses a handle for a hand tool.

While these devices fulfill their respective, particular objectives and requirements, the aforementioned patents do not describe a barbell system that allows improving the gripability of barbell systems.

In this respect, the barbell system according to the present invention substantially departs from the conventional concepts and designs of the prior art, and in doing so provides an apparatus primarily developed for the purpose of improving the gripability of barbell systems.

Therefore, it can be appreciated that there exists a continuing need for a new and improved barbell system which can be used for improving the gripability of barbell systems. In this regard, the present invention substantially fulfills this need.

SUMMARY OF THE INVENTION

In view of the foregoing disadvantages inherent in the known types of barbells and grips of known designs and configurations now present in the prior art, the present invention provides an improved barbell system. As such, the general purpose of the present invention, which will be described subsequently in greater detail, is to provide a new and improved barbell system and method which has all the advantages of the prior art and none of the disadvantages.

To attain this, the present invention essentially comprises a new and improved barbell system with improved gripability. A cylindrical shaft is first provided. The shaft has a circular cross section with a diameter of about ¾ inch. The shaft also has an axial length of about 9¼ inch. The length of each end region of the shaft is about 2 inches. The length of the central region of the shaft is about 5¼ inches. Next provided are a pair of generally cylindrical weights. Each weight has a central bore of about ¾ inch diameter and an axial length of about 1 inch. The weights are adapted to be received and supported on the end regions of the shaft. Threaded collars are next provided to couple with threads on the ends of the shaft. The threaded collars function to releasably retain the weight to the shaft. Each of the weights is formed with a periphery having a plurality of planar faces symmetrically oriented there around. Lastly, a grip is provided. The grip is fabricated in one piece of an elastomeric material. The elastomeric material may be of plastic or rubber, natural or synthetic, or blends thereof. The grip has an axial length of about 5¼ inches. The grip has an axial bore with a diameter of about ¾ inch positioned over the central extent of the shaft. The grip has planar end faces adapted to contact and position the weights on the shaft. The grip also has a contoured exterior surface. The contoured exterior surface has a maximum diameter of about 1½ inches at its radial central plane and at its ends. The exterior surface has a minimum diameter of 1³⁄₁₆ inches at its radial intermediate planes. The contoured exterior surface is symmetrically positioned between the central plane and the ends. The exterior surface is formed with three circumferentially positioned regions around the periphery to form three flat central ovals and six flat end semi-ovals. The central ovals are all located in three planes 120 degrees from each other with a 2⅜ inch long major axis parallel with the axis of the grip and shaft and a ¹¹⁄₁₆ inch long minor axis transverse thereto. The semi-ovals are formed with two per set. The semi-ovals are coplanar with the three central ovals at the ends of the grip. The semi-ovals each have an axial major axis of about ½ inch in length and a transverse minor axis of about ¾ inch in length.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved barbell system which has all of the advantages of the prior art barbells and grips of known designs and configurations and none of the disadvantages.

It is another object of the present invention to provide a new and improved barbell system which may be easily and efficiently manufactured and marketed.

It is further object of the present invention to provide a new and improved barbell system which is of durable and reliable constructions.

An even further object of the present invention is to provide a new and improved barbell system which is susceptible of a low cost of manufacture with regard to both materials and labor, and which accordingly is then susceptible of low prices of sale to the consuming public, thereby making such barbell system economically available to the buying public.

Even still another object of the present invention is to provide a barbell system for improving the gripability of barbell systems.

Lastly, it is an object of the present invention to provide a new and improved barbell system including a grip having an axial length and an axial bore with a diameter and planar end faces and a contoured exterior surface, the contoured exterior surface having a maximum diameter at its radial central plane and at its ends with a minimum diameter at its radial intermediate planes symmetrically positioned between the central plane and the ends, the exterior surface being formed with three circumferentially positioned regions around the periphery to form flat ovals, the central ovals all being located in three planes 120 degrees from each other with a major axis parallel with the axis of the grip and shaft and a minor axis transverse thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIG. 4 is a cross sectional view taken along line 4—4 of FIG. 1.

FIG. 5 is a front elevational view of the present invention but constructed in accordance with an alternate embodiment of the invention.

FIG. 6 is a cross sectional view taken along line 6—6 of FIG. 5.

The same reference numerals refer to the same parts throughout the various Figures.

DESCRIPTION OF THE PREFERRED EMBODIMENT

Figure 1:
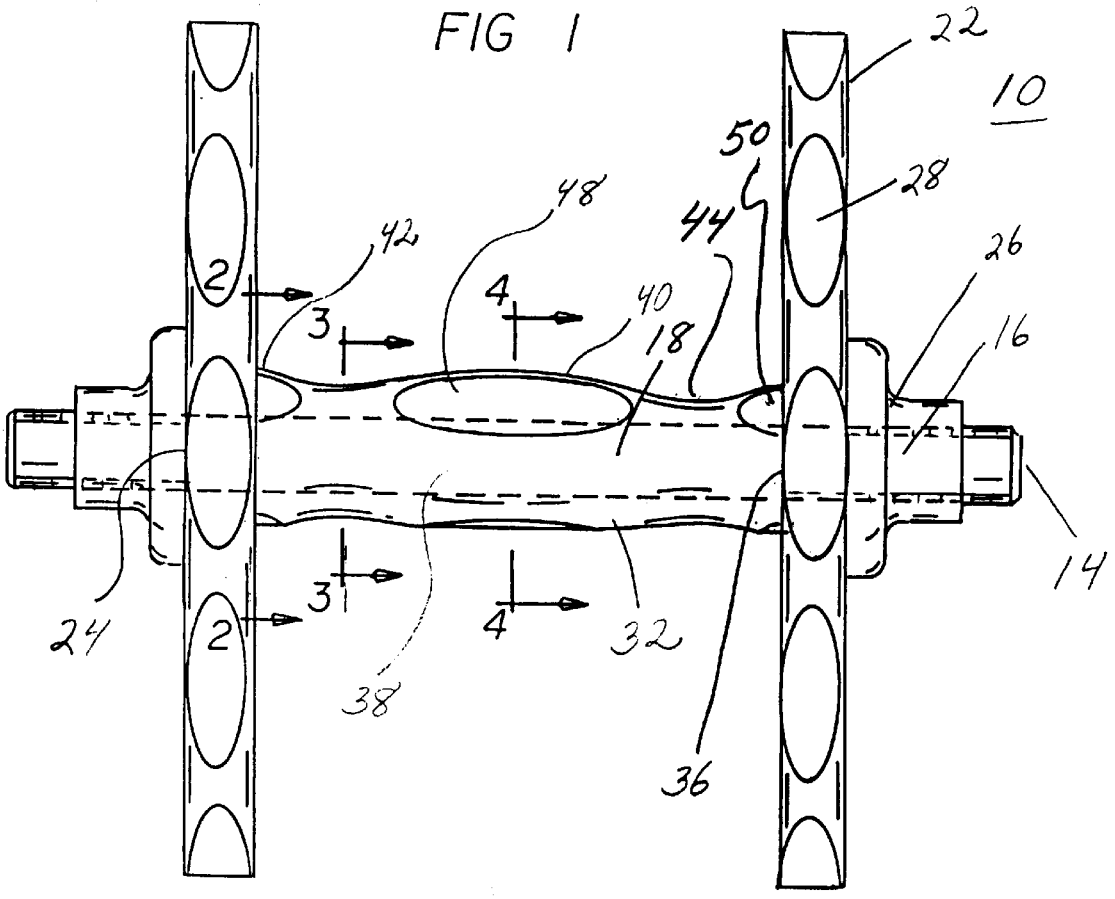
FIG. 1 is a front elevational view of the new and improved barbell system constructed in accordance with the principles of the present invention.
Figure 2:
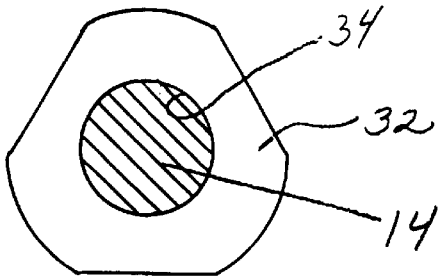
FIG. 2 is a cross sectional view taken along line 2—2 of FIG. 1.

With reference now to the drawings, and in particular to FIG. 1 thereof, the preferred embodiment of the new and improved barbell system embodying the principles and concepts of the present invention and generally designated by the reference numeral 10 will be described.

The present invention, the barbell system 10 is comprised of a plurality of components. Such components in their broadest context include a shaft, a pair of weights, and a grip. Such components are individually configured and correlated with respect to each other so as to attain the desired objective.

In the preferred embodiment, a cylindrical shaft 14 is provided. The cylindrical shaft has a circular cross section with a diameter of about ¾ inch. The cylindrical shaft also has an axial length of about 9¼ inches. The length of each end region 16 of the shaft is about 2 inches. The length of the central region 18 of the shaft is about 5¼ inches.

Next provided are a pair of generally cylindrical weights 22. Each weight has a central bore 24 of about ¾ inch and an axial length of about 1 inch. The weights are adapted to be received and supported on the end regions of the cylindrical shaft. Threaded collars 26 are next provided to couple with threads on the ends of the shaft. The threaded collars function to releasably retain the weight to the shaft. Each of the weights is formed with a periphery having a plurality of planar faces 28 symmetrically oriented there around.

Lastly, a grip 32 is provided. The grip is fabricated in one piece of an elastomeric material. The elastomeric material may be plastic or rubber, natural or synthetic, or blends thereof. The grip has an axial length of about 5¼ inches. The grip has an axial bore 34 with a diameter of about ¾ inch positioned over the central extent of the cylindrical shaft. The grip has planar end faces 36 adapted to contact and position the weights on the shaft. The grip also has a contoured exterior surface 38. The contoured exterior surface has a maximum diameter of about 1½ inches at its radial central plane 40 and at its ends 42. The exterior surface has a minimum diameter of 1³⁄₁₆ inches at its radial intermediate planes 44. The contoured exterior surface is symmetrically positioned between the central plane and the ends. The exterior surface is formed with three circumferentially positioned regions around the periphery to form three flat central ovals 48 and six flat end semi-ovals 50. The central ovals are all located in three planes 120 degrees from each other with a 2⅜ inch long major axis parallel with the axis of the grip and shaft and a ¹¹⁄₁₆ inch long minor axis transverse thereto. The semi-ovals are formed with two per set. The semi-ovals are coplanar with the three central ovals at the ends of the grip. The semi-ovals each have an axial major axis of about ½ inch in length and a transverse minor axis of about ¾ inch in length.

An alternate embodiment of the invention is shown in FIGS. 5 and 6. In such embodiment, the grip 54 is fabricated of a metallic material, preferably steel. In addition, there is formed over the grip a relatively thin elastomeric layer 56. Such layer is provided for added comfort and may be fabricated of any plastic or rubber, natural or synthetic, or blends thereof. In this embodiment, the weights 60 are preferably formed integral with, and at the axial ends of, the grip.

Different shaped grips are known in the prior art. They are mainly round shaped columns, oval shaped columns, and a tri-bar shape. All have inevitable shortcomings.

The round shaped grip does not fully consider the intricate bones of the human hand. This shape allows a curved space between the human hand palm and the grip. Looking at a cross section of a gripped human hand, the center palm is hollow, so as to leave an oval shaped space when gripping. The result is muscular and joint fatigue when trying to grip the handle firmly in an attempt to eliminate the space between the hand and the grip. With this shape, the grip can easily slip when held vertically.

The oval shaped handle has a thick center and slims gradually toward two ends. It overcomes the shortcomings of the hollow in the palm section, reducing the muscular and joint fatigue, but there is still a space between the fingers and grip because it does not take into account another aspect, i.e.

looking at the cross section of a gripped hand, the shape is multi-sided, nearly triangle, which is formed by the finger joints and the muscle group.

The tri-bar shape considers the intricate bones of the human hand, but it neglects the hollow in the palm section. The present invention overcomes all shortcomings of the prior art devices and offers a perfect gripping system, which works naturally and completely with the structure, bones, and muscle of the human hand.

The present invention is formed as an oval shaped, hex-sided column of 6 sides, 3 flat sides and 3 rounded sides. When viewed in cross-section it is of a curved shaped hexagon. When gripping, there will be no space between the fingers and the grip. It suits perfectly the nature of gripped human hands, taking into account the intricate bones of the human hand. The vertical section is oval shaped. It leaves no space between the palm and handle. It also suits the characteristics and physiology of all human fingers, i.e., different lengths of forefinger, middle finger, ring finger, and little finger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved barbell system with improved gripability comprising, in combination:

a cylindrical shaft having a circular cross section with a diameter of about ¾ inch and having an axial length of about 9¼ inches, the shaft having end regions of about 2 inches each and a central region of about 5¼ inches, the end regions being provided with threads thereon;

a pair of generally cylindrical weights, each having a central bore of about ¾ inch and an axial length of about 1 inch adapted to be received and supported on the end regions of the cylindrical shaft with threaded collars to releasably retain the weights to the shaft, each of the weights being formed with a periphery having a plurality of planar faces symmetrically oriented there around; and a grip fabricated in one piece of an elastomeric material, plastic or rubber, natural or synthetic, or blends thereof, having an axial length of about 5¼ inches and an axial bore with a diameter of about ¾ inch positioned over the central extent of the cylindrical shaft, the grip having planar end faces adapted to contact and position the weights on the shaft and a contoured exterior surface, the contoured exterior surface having a maximum diameter of about 1½ inches at its radial central plane and at its ends with a minimum diameter of 1 3/16 inches at its radial intermediate planes symmetrically positioned between the central plane and the ends, the exterior surface being formed with three circumferentially positioned regions around the periphery to form three flat central ovals and six flat end semi-ovals, the central ovals all being located in three planes 120 degrees from each other with a 2⅜ inch long major axis parallel with the axis of the grip and shaft and a 11/16 inch long minor axis transverse thereto and with the semi-ovals being formed with two per set coplanar with the three central ovals at the ends of the grip each having an axial major axis of about ½ inch in length and a transverse minor axis of about ¾ inch in length, the planar end faces of the grip having a cross-sectional size and shape as the cross-sectional size and share at the axial center of the strip.

2. A grip for use with a barbell system having an axial length and a bore and planar end faces and a contoured exterior surface, the contoured exterior surface having a maximum circumference at its radial central plane and at its ends with a minimum circumference at its radial intermediate planes symmetrically positioned between the central plane and the ends, the exterior surface being formed with three circumferentially positioned regions around the periphery to form three flat central ovals and six flat semi-cylindrical end ovals, the central ovals and end ovals all being located in three planes 120 degrees from each other with a major axis parallel with the axis of the grip and shaft and a minor axis transverse thereto, the planar end faces of the grip having a cross-sectional size and share as the cross-sectional size and shape at the axial center of the grip.

3. The grip as set forth in claim 2 wherein the material for fabrication is an elastomeric material, plastic or rubber, natural of synthetic, or blends thereof.

4. The grip as set forth in claim 2 and further including a shaft extending through the bore, the shaft being fabricated of steel with a central region within the grip and with end regions extending beyond the grip.

5. The grip as set forth in claim 4 and further including at least one weight removably secured to the shaft at each end region.

6. The grip as set forth in claim 5 wherein each weight includes a periphery with a plurality of flat regions spaced there around.

7. The grip as set forth in claim 2 wherein the material of fabrication is a metallic material with a relatively thin elastomeric layer there over.

* * * * *